US008922436B2

(12) United States Patent
Stone et al.

(10) Patent No.: US 8,922,436 B2
(45) Date of Patent: Dec. 30, 2014

(54) PLASMA AVIATION ANTENNA

(71) Applicant: Smartsky Networks, LLC, Charlotte, NC (US)

(72) Inventors: Ryan Mitchell Stone, Charlotte, NC (US); Elbert Stanford Eskridge, Jr., Chapel Hill, NC (US)

(73) Assignee: Smartsky Networks LLC, Charlotte, NC (US)

( * ) Notice: Subject to any disclaimer, the term of this patent is extended or adjusted under 35 U.S.C. 154(b) by 0 days.

(21) Appl. No.: 13/892,518

(22) Filed: May 13, 2013

(65) Prior Publication Data

US 2014/0333485 A1 Nov. 13, 2014

(51) Int. Cl.

| | |
|---|---|
| ***H01Q 1/26*** | (2006.01) |
| ***H01Q 1/36*** | (2006.01) |
| ***H01Q 1/28*** | (2006.01) |

(52) U.S. Cl.

CPC . *H01Q 1/366* (2013.01); *H01Q 1/28* (2013.01)
USPC ..... 343/701; 343/705; 343/708

(58) Field of Classification Search

USPC ..... 343/701, 705, 708
See application file for complete search history.

(56) References Cited

U.S. PATENT DOCUMENTS

| | | | | |
|---|---|---|---|---|
| 3,544,998 | A * | 12/1970 | Vandenplas et al. | 343/701 |
| 6,012,675 | A * | 1/2000 | Cocatre-Zilgien | 244/16 |
| 7,292,191 | B2 * | 11/2007 | Anderson | 343/701 |
| 8,059,043 | B2 * | 11/2011 | Brady et al. | 343/705 |
| 2005/0024236 | A1 * | 2/2005 | Gosdin et al. | 340/905 |
| 2011/0025565 | A1 * | 2/2011 | Anderson | 343/701 |
| 2012/0202418 | A1 * | 8/2012 | Jalali et al. | 455/15 |

* cited by examiner

*Primary Examiner* — Dieu H Duong

(74) *Attorney, Agent, or Firm* — Nelson Mullins Riley & Scarborough LLP

(57) ABSTRACT

An aircraft communications system may include a RF-transparent enclosure, a plasma antenna element and a controller. The RF-transparent enclosure may be disposed substantially conformal with a portion of the aircraft. The plasma antenna element may be housed within the RF-transparent enclosure. The controller may be operably coupled to the plasma antenna element to provide control of operation of the plasma antenna element. The plasma antenna element may include one or more RF-conductive plasma devices that are selectively ionized to a plasma state under control of the controller.

16 Claims, 10 Drawing Sheets

PLASMA AVIATION ANTENNA

TECHNICAL FIELD

Example embodiments generally relate to wireless communications and, more particularly, relate to the use of a plasma antenna on an aircraft.

BACKGROUND

High speed data communications and the devices that enable such communications have become ubiquitous in modern society. These devices make many users capable of maintaining nearly continuous connectivity to the Internet and other communication networks. Although these high speed data connections are available through telephone lines, cable modems or other such devices that have a physical wired connection, wireless connections have revolutionized our ability to stay connected without sacrificing mobility.

However, in spite of the familiarity that people have with remaining continuously connected to networks while on the ground, people generally understand that easy and/or cheap connectivity will tend to stop once an aircraft is boarded. Aviation platforms have still not become easily and cheaply connected to communication networks, at least for the passengers onboard. Attempts to stay connected in the air are typically costly and have bandwidth limitations or high latency problems. Moreover, passengers willing to deal with the expense and issues presented by aircraft communication capabilities are often limited to very specific communication modes that are supported by the rigid communication architecture provided on the aircraft.

The provision of wireless communications to receivers onboard aircraft in the context of an air-to-ground (ATG) communication system means that connectivity must be assured within a three dimensional environment instead of the typically two dimensional environment considered for conventional land based wireless communications. The addition of a third dimension (i.e., altitude) coupled with the fact that aircraft antennas would preferably have a relatively low profile to reduce drag means that conventional antennas are likely not optimal for use in ATG systems. Accordingly, it may be desirable to provide for improved antennas and other components to facilitate improved operation of such components within ATG systems.

BRIEF SUMMARY OF SOME EXAMPLES

Some example embodiments may therefore be provided in order to enable the provision of communications equipment, and particularly antennas, within radio frequency (RF)-transparent enclosures on the aircraft, such as the windows of the aircraft. By providing antennas within windows of the aircraft, a conformal antenna may be provided without creating extra penetrations through the skin of the aircraft, which minimizes installation and installation testing complexity while also keeping drag to a minimum. Further, since ionized gas plasma can be visually transparent or made in a small form factor, the plasma antenna would not substantially diminish the primary functionality of its housing in the specialized case where the housing is an aircraft window. Example embodiments may also provide for the use of plasma antenna elements within the RF-transparent enclosures so that advantages that can be provided by plasma antennas can be experienced by airborne assets. Moreover, example embodiments provide for the use of plasma antenna elements in a way that produces a highly flexible and configurable communication structure that can be implemented in a desired manner on the basis of requirements for a mission or an individual flight. With such a system, aircraft can take full advantage of the unique attributes of plasma antenna elements while minimizing drag and ease of installation and testing. Plasma antenna advantages include but are not limited to low thermal noise, invisibility to radar when switched off or to a lower frequency than the radar, resistance to electronic warfare, plus the versatility provided by dynamic tuning and reconfigurability for frequency, direction, bandwidth, gain, and beamwidth in both static and dynamic modes of operation.

In one example embodiment, an aircraft communications system is provided. The aircraft communications system may include a RF-transparent enclosure, a plasma antenna element and a controller. The RF-transparent enclosure may be disposed substantially conformal with skin of the aircraft. The plasma antenna element may be housed within the RF-transparent enclosure. The controller may be operably coupled to the plasma antenna element to provide control of operation of the plasma antenna element. The plasma antenna element may include one or more RF-conductive plasma devices (e.g., plasma discharge tubes including gas that is selectively ionized to a plasma state or solid-state plasma antenna elements that create plasma from electrons generated by activating diodes on a silicon chip), under control of the controller.

In another example embodiment, a modular aircraft window is provided. The modular aircraft window may include a RF-transparent enclosure, a plasma antenna element and a controller. The RF-transparent enclosure may be disposed substantially conformal with skin of the aircraft. The RF-transparent enclosure may include a fixed outer pane and a removable inner pane. The plasma antenna element may be housed within the RF-transparent enclosure. The controller may be operably coupled to the plasma antenna element to provide control of operation of the plasma antenna element. The plasma antenna element may include one or more RF-conductive plasma devices including gas that is selectively ionized to a plasma state under control of the controller. The inner pane of the window structure may be removable to enable replacement of the plasma antenna element to a selected one of a plurality of preconfigured structures.

In still another example embodiment, a method of employing a plasma antenna element is provided. The method may include determining a selected operating frequency for communication from an aircraft to an external communication network, selectively energizing at least one plasma discharge tube to configure a plasma antenna element to utilize the selected operating frequency, and employing radio circuitry associated with the selected operating frequency to conduct communication with the external communication network.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION

Figure 1:
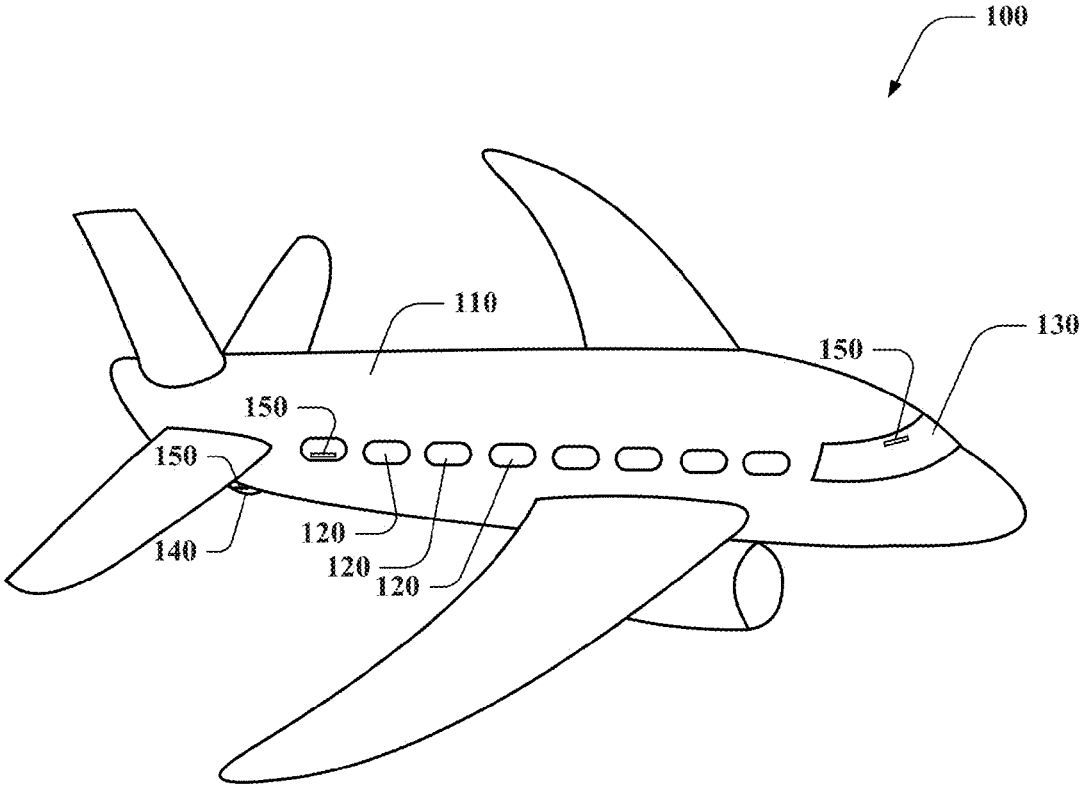
FIG. 1 illustrates an aircraft capable of employing one or more plasma aviation antennas in accordance with an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements such as reference numerals refer to like elements throughout. Furthermore, as used herein, the term "or" is to be interpreted as a logical operator that results in true whenever one or more of its operands are true. As used herein, the terms "data," "content," "information" and similar terms may be used interchangeably to refer to data capable of being transmitted, received and/or stored in accordance with example embodiments. As used herein, the term "aircraft" should be understood to include any airborne or space borne vehicle, whether manned or unmanned. Thus, use of any such terms should not be taken to limit the spirit and scope of example embodiments.

As used in herein in relation to computer-related functionality, the terms "component," "module," and the like are intended to include a computer-related entity, such as but not limited to hardware, firmware, a combination of hardware and software, software, or software in execution. For example, a component may be, but is not limited to being, a process running on a processor, a processor, an object, an executable, a thread of execution, a program, and/or a computer. By way of example, both an application running on a computing device and/or the computing device can be a component. One or more components can reside within a process and/or thread of execution and a component may be localized on one computer and/or distributed between two or more computers. In addition, these components can execute from various computer readable media having various data structures stored thereon. The components may communicate by way of local and/or remote processes such as in accordance with a signal having one or more data packets, such as data from one component interacting with another component in a local system, distributed system, and/or across a network such as the Internet with other systems by way of the signal.

Artificial intelligence based systems (e.g., explicitly and/or implicitly trained control modules) can be employed in connection with performing inference and/or probabilistic determinations and/or statistical-based determinations in accordance with one or more aspects of the subject matter as described hereinafter. As used herein, the term "inference" refers generally to the process of reasoning about or inferring states of the system, environment, and/or user from a set of observations as captured via events and/or data. Inference can be employed to identify a specific context or action, or can generate a probability distribution over states, for example. The inference can be probabilistic—that is, the computation of a probability distribution over states of interest based on a consideration of data and events. Inference can also refer to techniques employed for generating higher-level events from a set of events and/or data. Such inference results in the construction of new events or actions from a set of observed events or stored event data, regardless of whether the events are correlated in close temporal proximity, and whether the events and data come from one or several event and data sources. Various classification schemes and/or systems (e.g., support vector machines, neural networks, expert systems, Bayesian belief networks, fuzzy logic, data fusion engines, etc.), for example, can be employed in connection with performing automatic and/or inferred actions in connection with the subject matter. In some cases, an inferred state of an aircraft or communications equipment on or associated with an aircraft may be used as a basis for configuring a plasma antenna element of the communications system of the aircraft as described in greater detail below.

Some example embodiments described herein may provide a device or system in which a component is provided to control operation of a plasma antenna element housed within a RF-transparent enclosure onboard an aircraft. The plasma antenna element may be operated under the control of the component to function as a radiating antenna, a receiving antenna, a reflector or a lens to manipulate radio frequency (RF) signals associated with wireless communication in an ATG network. The arrangements of the plasma antenna element or elements of some example embodiments may allow the component to configure the plasma antenna element or elements to support communication over one or multiple frequencies sequentially, simultaneously and/or selectively.

Some example embodiments may employ characteristics of stealth, interference resistance and rapid reconfigurability in order to provide an adaptable and highly capable mobile communication platform. Moreover, the plasma antenna element of some embodiments may be embedded within an aircraft window in order to utilize the window as the transparent enclosure. The window may therefore provide upward looking, side looking, forward looking, downward looking, aft looking or steerable beams for communication with ground based, aircraft based, or satellite based communication equipment without requiring the use of antennas that penetrate the fuselage. Meanwhile, a controller onboard the aircraft may respond to external stimuli or follow internal programming to make inferences and/or probabilistic determinations about how to steer beams, select array lengths, employ channels/frequencies for communication with various onboard and external communications equipment. Load balancing, antenna beam steering, interference mitigation, network security and/or denial of service functions may therefore be enhanced by the operation of some embodiments.

FIG. 1 illustrates an example aircraft 100 that may employ example embodiments. It should be appreciated that the aircraft 100 shown is merely one example. Thus, although FIG. 1 illustrates a passenger liner, it should be appreciated that example embodiments pertain to other aircraft as well including helicopters, private jets, military aircraft, space vehicles, unmanned aerial vehicles (UAVs), inflatables, dirigibles, and/or the like. As shown in FIG. 1, the aircraft has a fuselage 110 from which wings may be extended. The fuselage 110 may include a series of side windows 120 extending linearly along each opposing side of the fuselage 110. A cockpit window 130 may be provided near the nose at the forward end of the fuselage 110. In some cases, the cockpit window 130 may have an upward and forward facing orientation to provide the pilot with a commanding view of the area around the aircraft 100.

In an example embodiment, any or all of the side windows 120 and the cockpit window 130 may function as or include an RF-transparent enclosure housing one or more plasma antenna elements 150. In some cases, to provide a downward (and/or rearward) facing plasma antenna element 150, a RF-transparent enclosure 140 could be provided at another location on the fuselage 110 such as near the tail and/or on the underside of the fuselage 110. The RF-transparent enclosure 140 may be provided to be substantially conformal with the skin of the fuselage 110 or some other component of the aircraft 100. Thus, for example, the RF-transparent enclosure 140 may be completely conformal with, or may protrude slightly from the skin of the aircraft 100 or from wings, fins, modified fins or any other portion of the aircraft 100. Moreover, in some embodiments, the RF-transparent enclosure 140 may also perform other functions such as housing of lighting components or other aircraft equipment. Thus, for example, the RF-transparent enclosure 140 could be a lighting receptacle in some cases.

In an example embodiment, the RF-transparent enclosures forming one or more of the side windows 120, the cockpit window 130 or the RF-transparent enclosure 140 may be made from glass or glass substitutes (e.g., PMMA, acrylic glass, polycarbonate, transparent thermoplastic, and/or the like). The RF-transparent enclosures may be flexible or rigid in various alternative example embodiments. However, in some embodiments, the RF-transparent enclosures themselves may be substantially flexible until they are set within an opening forming the side windows 120, the cockpit window 130 or the transparent enclosure 140, at which time they may remain held in place such that they are essentially rigid.

In some cases, the RF-transparent enclosures (particularly side windows 120) may be made of electrochromic glass, which may utilize the application of a voltage to the window to shift the window from a transparent to a translucent state. The RF-transparent enclosures may enclose the plasma antenna elements 150 between panes or layers of material forming the RF-transparent enclosures, or within compartments, hollow areas, or other void spaces formed or otherwise provided within the RF-transparent enclosures. In examples in which electrochromic glass is employed, a common power source may be provided for ionization of plasma in the plasma antenna elements 150 and for control over the state of the electrochromic glass.

As will be described in greater detail below, one or more of the plasma antenna elements 150 may be configured to support wireless communication between external communication equipment and the aircraft 100 or communications equipment thereon. The provision of the plasma antenna elements 150 for communications support may provide for configurable communications capabilities while minimizing the penetrations through the fuselage 110 and also minimizing the drag associated with providing communications antennas for the aircraft 100. In this regard, the provision of communications antennas within windows that are already provided in the aircraft fuselage 110 anyway means that additional penetrations dedicated to support of communications equipment can be either completely avoided or at least reduced. Moreover, even to the extent that an additional penetration through the aircraft skin is needed to support connection to the RF-transparent enclosure 140 at a rear and/or underside of the aircraft, the form factor of the RF-transparent enclosure 140 may be such that it is substantially conformal with the aircraft skin and therefore does not protrude substantially away from the aircraft skin to increase drag significantly.

The plasma antenna elements 150 may communicate with external communication devices (e.g., satellite, other aircraft, or terrestrial (including seaborne) base stations) and provide data to/from equipment onboard the aircraft 100. The equipment onboard the aircraft 100 may include passenger equipment (e.g., personal or in-seat communication devices), service equipment, sensors, navigation equipment and/or communication equipment of the aircraft itself. Incoming communications received from the external communication devices may be received at or with the assistance of the plasma antenna elements 150 and may be routed to any suitable radio circuitry prior to delivery to an output device. Likewise, outgoing communications may be processed by any suitable radio circuitry prior to delivery to the plasma antenna elements 150 for transmission to the external communication devices.

In an ATG or satellite communications system, the end-user equipment (e.g., wired and wireless routers, mobile phones, laptop computers, on-board entertainment systems, and/or the like) may be installed or otherwise present on the aircraft 100. The user equipment (UE) and any receiving and/or transmitting device on the aircraft 100 may form communication nodes of an onboard communications network. A WiFi hotspot, router, server, or other local distribution/communications management device may be used to provide a common wireless input/output node for wireless communications within the onboard communications network. Accordingly, for example, the plasma antenna elements 150 may provide signals (directly or indirectly) to/from the hotspot, router, server or other local distribution/communications management device.

Figure 2:
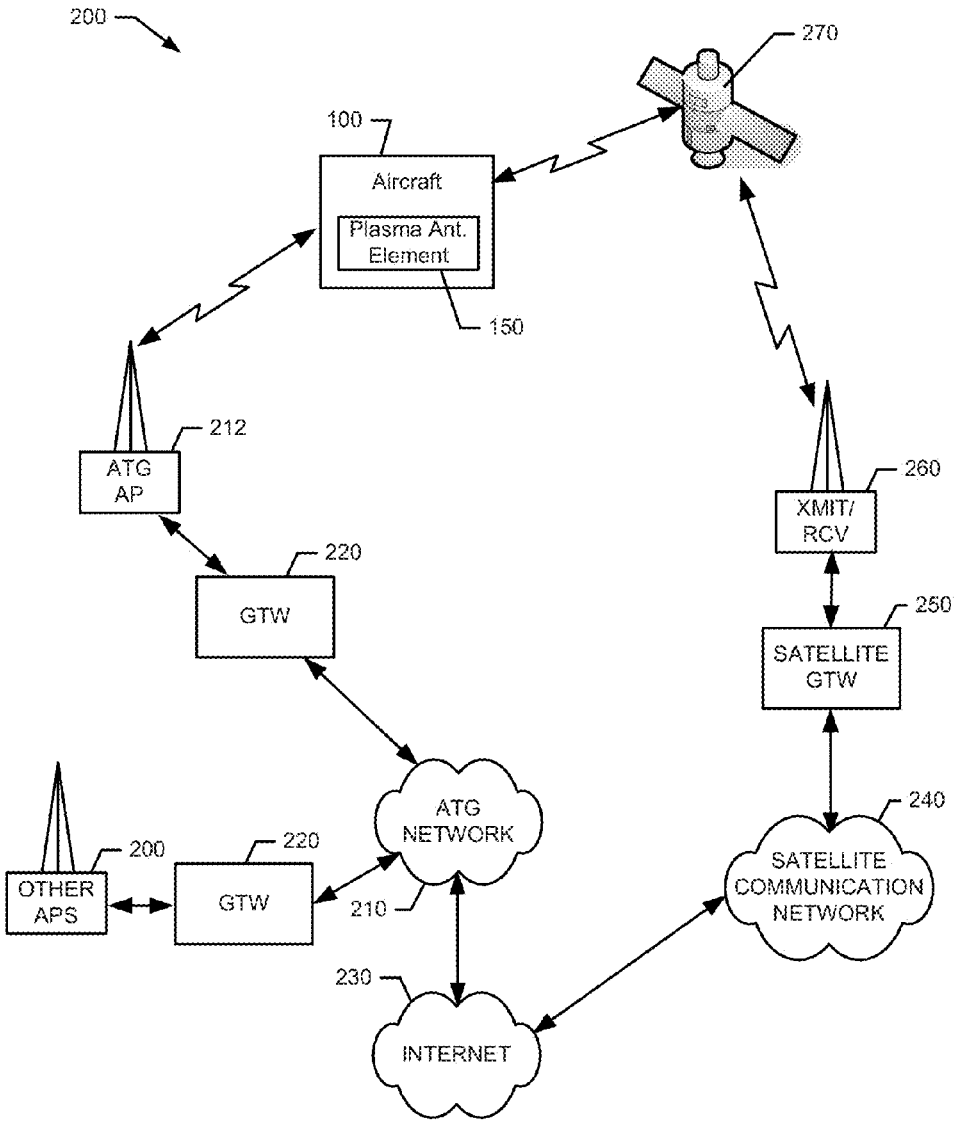
FIG. 2 illustrates a functional block diagram of a network in which plasma antenna elements of an example embodiment may be employed.

FIG. 2 illustrates a functional block diagram of a network 200 in which the plasma antenna elements 150 of an example embodiment may be employed. As shown in FIG. 2, the network 200 may include base stations associated with an ATG network 210. The base stations may include an ATG access point (AP) 212 and one or more other access points (APs) 214. The ATG network 210 may further include other access points (APs) as well, and each of the APs may be in communication with the ATG network 210 via a gateway (GTW) device 220. The ATG network 210 may further be in communication with a wide area network such as the Internet 230, Virtual Private Networks (VPNs) or other communication networks. In some embodiments, the ATG network 210 may include or otherwise be coupled to a packet-switched core or other telecommunications network.

In an example embodiment, the ATG network 210 may include a network controller or other such device that may include, for example, switching functionality. Thus, for example, the network controller may be configured to handle routing voice, video or data to and from the aircraft 100 (or to mobile communication nodes of or on the aircraft 100) and/or handle other data or communication transfers between the mobile communication nodes of or on the aircraft 110 and the ATG network 210. In some embodiments, the network controller may function to provide a connection to landline trunks when the mobile communication nodes of or on the aircraft 100 is involved in a call. In addition, the network controller may be configured for controlling the forwarding of messages and/or data to and from the mobile communication nodes of or on the aircraft 100, and may also control the forwarding of messages for the APs. The network controller may be coupled to a data network, such as a local area network (LAN), a metropolitan area network (MAN), and/or a wide area network (WAN) (e.g., the Internet 230) and may be directly or indirectly coupled to the data network. In turn, devices such as processing elements (e.g., personal computers, laptop computers, smartphones, server computers or the like) can be coupled to the mobile communication nodes of or on the aircraft 100 via the Internet 230.

In some embodiments, a satellite communications network 240 may additionally or alternatively be provided to facilitate communications with communication nodes on the aircraft 100. The satellite communications network 240 may include a satellite GTW 250 in communication with a satellite transmit/receive station 260 (e.g., a satellite dish) capable of communicating with a satellite 270. The satellite 270 may then wirelessly communicate with the communications nodes on the aircraft 100 via the plasma antenna elements 150.

Although not every element of every possible embodiment of the ATG network 210 and the satellite communications network 240 is shown and described herein, it should be appreciated that the mobile communication nodes of or on the aircraft 100 may be coupled to one or more of any of a number of different public or private networks through the ATG network 210 or the satellite communications network 240. In this regard, the network(s) can be capable of supporting communication in accordance with any one or more of a number of first-generation (1G), second-generation (2G), third-generation (3G), fourth-generation (4G) and/or future mobile communication protocols or the like in addition to any satellite communications protocols. In some cases, the communication supported may employ communication links defined using unlicensed band frequencies such as 2.4 GHz or 5.8 GHz.

Figure 3:
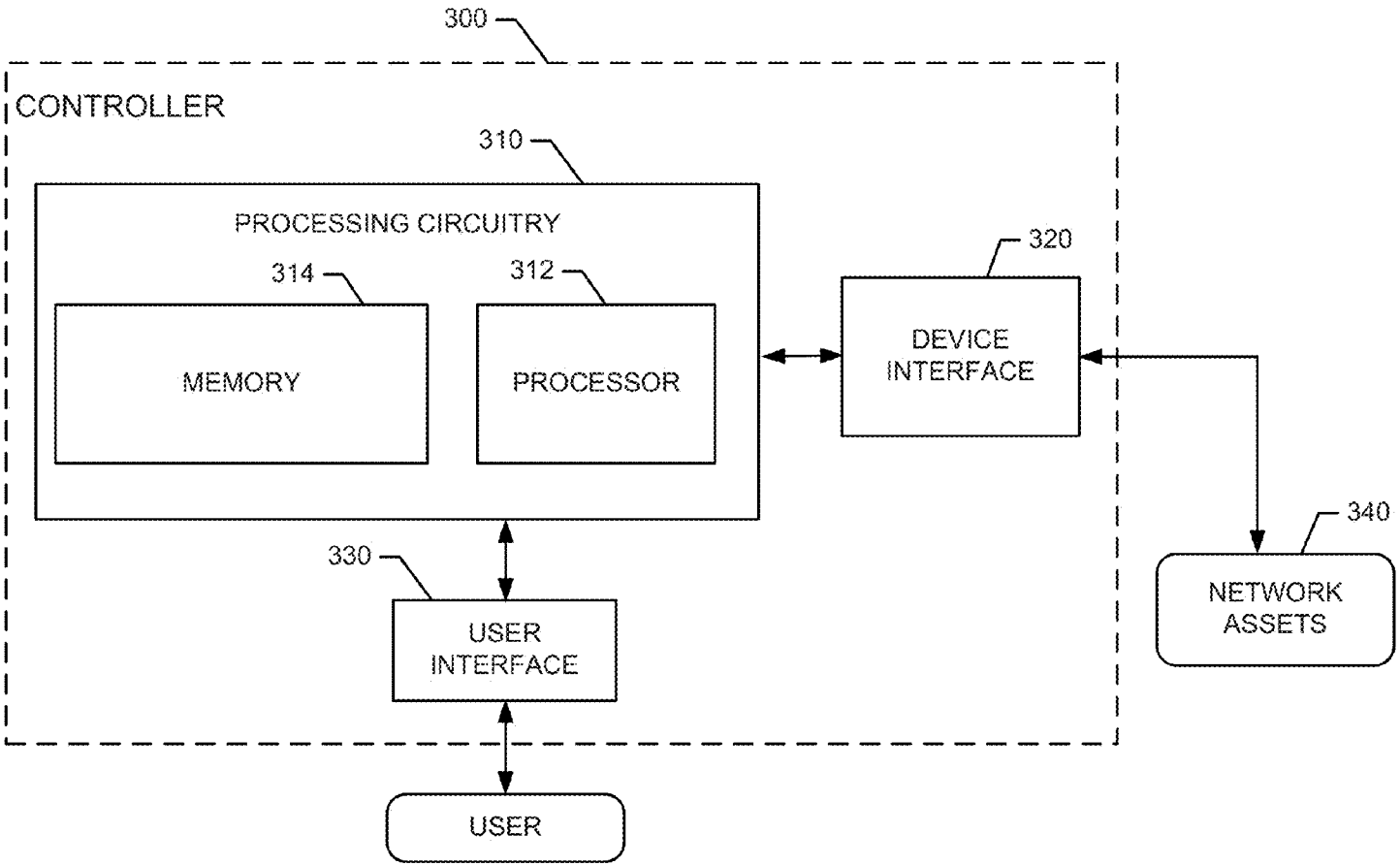
FIG. 3 illustrates one possible architecture for implementation of a controller that may be utilized to control operation of the plasma antenna elements in accordance with an example embodiment.

FIG. 3 illustrates one possible architecture for implementation of a controller 300 that may be utilized to control operation of the plasma antenna elements 150 in accordance with an example embodiment. The controller 300 may include processing circuitry 310 configured to provide control outputs for onboard communications network based on processing of various input information, programming information, control algorithms and/or the like. The processing circuitry 310 may be configured to perform data processing, control function execution and/or other processing and management services according to an example embodiment of the present invention. In some embodiments, the processing circuitry 310 may be embodied as a chip or chip set. In other words, the processing circuitry 310 may comprise one or more physical packages (e.g., chips) including materials, components and/or wires on a structural assembly (e.g., a baseboard). The structural assembly may provide physical strength, conservation of size, and/or limitation of electrical interaction for component circuitry included thereon. The processing circuitry 310 may therefore, in some cases, be configured to implement an embodiment of the present invention on a single chip or as a single "system on a chip." As such, in some cases, a chip or chipset may constitute means for performing one or more operations for providing the functionalities described herein.

In an example embodiment, the processing circuitry 310 may include one or more instances of a processor 312 and memory 314 that may be in communication with or otherwise control a device interface 320 and, in some cases, a user interface 330. As such, the processing circuitry 310 may be embodied as a circuit chip (e.g., an integrated circuit chip) configured (e.g., with hardware, software or a combination of hardware and software) to perform operations described herein. However, in some embodiments, the processing circuitry 310 may be embodied as a portion of an on-board computer. In some embodiments, the processing circuitry 310 may communicate with various components, entities, sensors and/or network assets 340 of the onboard communications network, which may include, for example, the plasma antenna elements 150.

The user interface 330 (if implemented) may be in communication with the processing circuitry 310 to receive an indication of a user input at the user interface 330 and/or to provide an audible, visual, mechanical or other output to the user. As such, the user interface 330 may include, for example, a display, one or more levers, switches, indicator lights, touchscreens, proximity devices, buttons or keys (e.g., function buttons), and/or other input/output mechanisms.

The device interface 320 may include one or more interface mechanisms for enabling communication with other devices (e.g., modules, entities, sensors and/or other components of the ATG network 210). In some cases, the device interface 320 may be any means such as a device or circuitry embodied in either hardware, or a combination of hardware and software that is configured to receive and/or transmit data from/to modules, entities, sensors and/or other components of the ATG network 210 that are in communication with the processing circuitry 310.

The processor 312 may be embodied in a number of different ways. For example, the processor 312 may be embodied as various processing means such as one or more of a microprocessor or other processing element, a coprocessor, a controller or various other computing or processing devices including integrated circuits such as, for example, an ASIC (application specific integrated circuit), an FPGA (field programmable gate array), or the like. In an example embodiment, the processor 312 may be configured to execute instructions stored in the memory 314 or otherwise accessible to the processor 312. As such, whether configured by hardware or by a combination of hardware and software, the processor 312 may represent an entity (e.g., physically embodied in circuitry—in the form of processing circuitry 310) capable of performing operations according to embodiments of the present invention while configured accordingly. Thus, for example, when the processor 312 is embodied as an ASIC, FPGA or the like, the processor 312 may be specifically configured hardware for conducting the operations described herein. Alternatively, as another example, when the processor 312 is embodied as an executor of software instructions, the instructions may specifically configure the processor 312 to perform the operations described herein.

In an example embodiment, the processor 312 (or the processing circuitry 310) may be embodied as, include or otherwise control the operation of the controller 300 based on inputs received by the processing circuitry 310. As such, in some embodiments, the processor 312 (or the processing circuitry 310) may be said to cause each of the operations described in connection with the controller 300 in relation to adjustments to be made to network configuration relative to providing service between access points and mobile communication nodes responsive to execution of instructions or algorithms configuring the processor 312 (or processing circuitry 310) accordingly. In particular, the instructions may include instructions for altering the configuration and/or operation of one or more of the plasma antenna elements 150 as described herein. The control instructions may mitigate interference, conduct load balancing, implement antenna beam steering, increase efficiency or otherwise improve network performance associated with establishing a communication link between the onboard communication nodes and respective ones of the external communication stations or access points as described herein.

In an exemplary embodiment, the memory 314 may include one or more non-transitory memory devices such as, for example, volatile and/or non-volatile memory that may be either fixed or removable. The memory 314 may be configured to store information, data, applications, instructions or the like for enabling the processing circuitry 310 to carry out various functions in accordance with exemplary embodiments of the present invention. For example, the memory 314 could be configured to buffer input data for processing by the processor 312. Additionally or alternatively, the memory 314 could be configured to store instructions for execution by the processor 312. As yet another alternative, the memory 314 may include one or more databases that may store a variety of data sets responsive to input sensors and components. Among the contents of the memory 314, applications and/or instructions may be stored for execution by the processor 312 in order to carry out the functionality associated with each respective application/instruction. In some cases, the applications may include instructions for providing inputs to control operation of the controller 300 as described herein.

Figure 4:
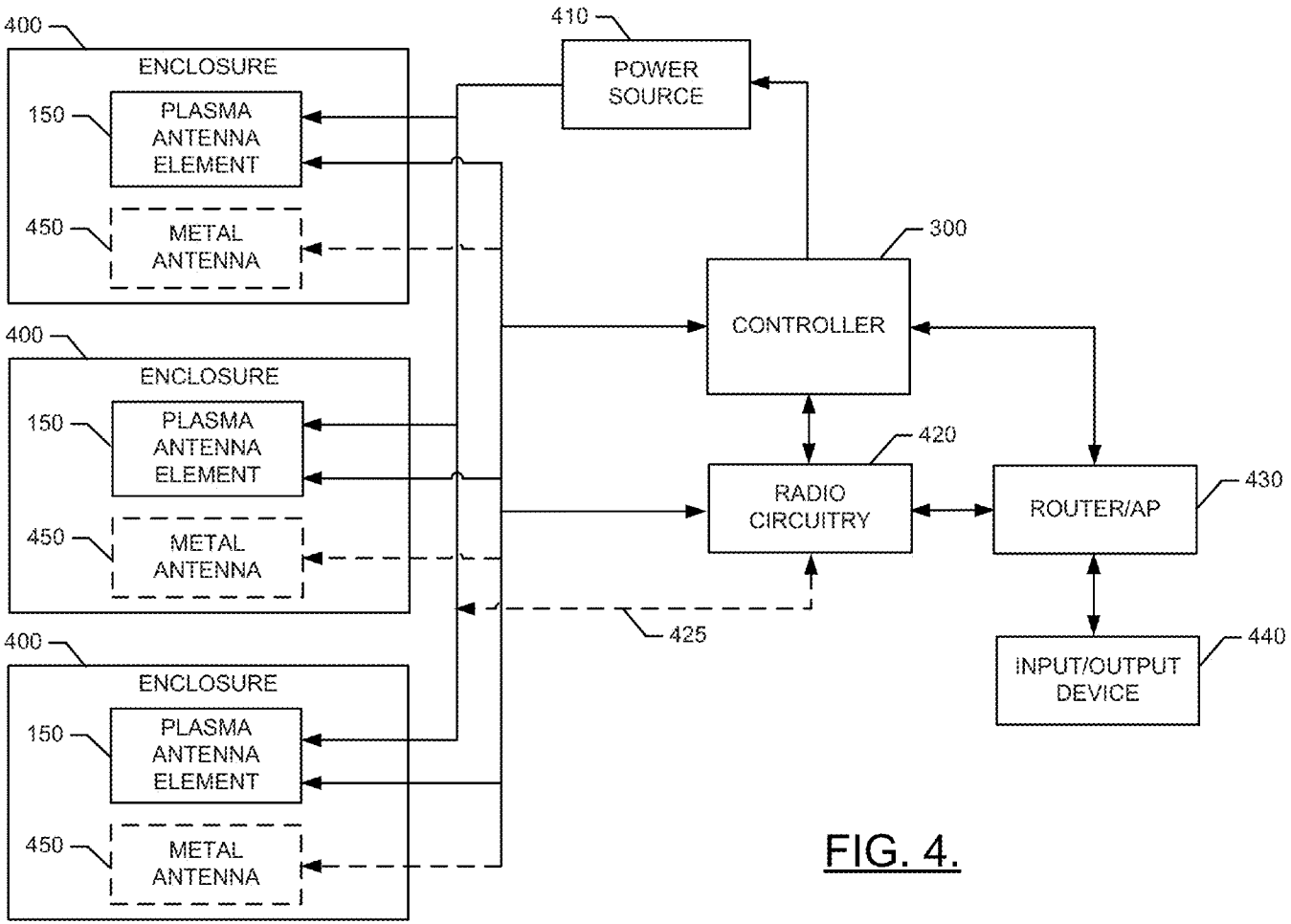
FIG. 4 illustrates a block diagram of an onboard communications network involving the plasma antenna elements according to an example embodiment.

FIG. 4 illustrates a block diagram of an onboard communications network involving the plasma antenna elements 150 according to an example embodiment. It should be appreciated that FIG. 4 is representative of one example architecture for defining functional interrelationships between components of an example system. Thus, other architectures are also possible. Moreover, even within FIG. 4, dashed lines are used to highlight components and/or connections that may form optional modified structures in some cases.

As shown in FIG. 4, one or more enclosures 400 may be provided such that each respective enclosure 400 may include at least one instance of the plasma antenna element 150. The plasma antenna elements 150 may be configured to be radiating and/or receiving antenna elements under the control of the controller 300. Accordingly, for example, the controller 300 may apply ionizing power (via control of a power source 410) to ionize the gas of the plasma antenna element 150 to form ionized gas plasma that is conductive. Alternatively or additionally, solid-state plasma antenna elements that create plasma from electrons generated by activating diodes on a silicon chip may also be utilized. Thus, as used herein, the term RF-conductive plasma device should be understand to correlate to plasma discharge tubes, solid-state plasma antenna elements or any other devices that are capable of utilizing plasma as a conductive medium responsive to ionization. The plasma antenna element 150 may therefore function as an antenna to radiate or receive RF transmissions based on the mode of operation of the plasma antenna element 150.

The power source 410 may operate under the control of the controller 300 to selectively power each of the plasma antenna elements 150. In some embodiments, the power may be provided through the controller 300 so that the controller 300 may selectively provide power from the power source 410 to the plasma antenna elements 150. However, as an alternative, the controller 300 may provide control inputs to the power source 410 to control provision of power from the power source 410 directly to the plasma antenna elements 150. The power source 410 may be a battery or other power source that is capable of delivering sufficient power to the plasma antenna elements 150 to cause ionization of the gas therein to form ionized gas plasma.

In some embodiments, the power source 410 may have a fixed voltage and voltages may be stepped up or down and/or converted (e.g., DC to AC) as appropriate or needed for various components of the system. For example, the power source 410 may have a relatively high voltage and voltages may be stepped down and provided to one or more power buses at desired levels. Alternatively or additionally, one or more transformers or other voltage converters may be used to step up voltages proximate to corresponding ones of the components of the system. In some cases, voltage may be stepped up proximate to each respective one of the plasma antenna elements 150 so that a lower voltage source may be employed and higher voltages can be generated only where needed. In some cases, the controller 300 may provide intelligent control over one or more of the switching devices or modulators that can be used to selectively power selected components.

In this regard, for example, the controller 300 may also provide control inputs to the plasma antenna elements 150. The control inputs may relate to beam forming control, mode control, array selection, frequency selection and/or other functions for which the plasma antenna elements 150 may be configured. The controller 300 may also communicate with and/or control radio circuitry 420 that may process signals received at the plasma antenna elements 150 or provide signals for transmission by the plasma antenna elements 150. In some embodiments, broadband data transmission lines may be provided between the plasma antenna elements 150 and the radio circuitry 420 so that data can be communicated therebetween. These transmission lines may be in addition to control lines connecting components to the controller 300. However, in some cases, broadband over power lines (BPL) techniques may be employed so that broadband data may be provided via the power lines connecting the power source 410 and the plasma antenna elements 150 to minimize the physical wiring needed to connect to each enclosure 400. BPL line 425 is provided to show an example in which the radio circuitry 420 may receive data from and provide data to the plasma antenna elements 150 via BPL.

In an example embodiment, after received data is demodulated and/or decoded at the radio circuitry 420, the data may be provided to a router or access point 430 for distribution to an output device (e.g., input/output device 440), which may be user equipment (UE) or other onboard electronics. Alternatively, when data generated at an input device (e.g., input/output device 440) is provided for transmission, the data may be received at the router or access point 430 for provision to the radio circuitry 420 prior to transmission via the plasma antenna elements 150 under control of the controller 300.

The plasma antenna elements 150 may employ discharge tubes or other suitable structures to contain gas that can be ionized by the addition of energy. The controller 300 may be configured to provide (e.g., via induction circuits or electrodes at ends of the discharge tubes and powered by a relatively high power ionizer) or control the application of sufficient energy to the gas to cause the gas to become ionized and pass into the plasma state. While the plasma antenna elements 150 are provided with sufficient power to generate plasma, the plasma acts as the guiding medium for electromagnetic radiation. Thus, the plasma antenna elements 150 may be used instead of metallic conducting elements of a conventional antenna to transmit or receive signals. Thus the plasma discharge tubes themselves become the antenna elements.

When the plasma discharge tubes do not receive sufficient energy to ionize the gas therein to the plasma state, the corresponding plasma antenna elements 150 are functionally turned off, and are transparent. In some cases, the plasma discharge tubes may glow when the gas therein is ionized due to coatings provided internal to the plasma discharge tubes. However, in other cases, the plasma discharge tubes may be substantially transparent even when ionized, if no coating is provided. Thus, for example, the plasma antenna elements 150 may be placed within windows (e.g., aircraft windows such as the side windows 120 and/or the cockpit window 130) and be relatively unnoticeable or at least not distracting regardless of their state of operation (i.e., off, transmitting, receiving, etc.).

In some cases, metal wires may be used to provide power and/or control signals where needed within or proximate to the windows (or panes). In other embodiments, the use of wires within the windows (or panes of the windows) may be avoided. In such examples, chemical vapor deposition etching or other techniques may be used to provide for routing of electrical signals or power within the windows (or panes thereof) in embodiments in which wires are not used.

Of note, the thermal noise of ionized gas plasma antennas such as the plasma antenna elements 150 is less than that which is experienced in metallic conducting elements at higher frequencies. Thus, in some cases, the plasma antenna elements 150 may provide a lower, and almost no noise floor. The plasma antenna elements 150 may also be resistant to interference. Moreover, when one element is turned off (e.g., deionized), the corresponding element is transparent to RF and therefore does not cause any backscatter that could interfere with adjacent elements or be detected as a radar return. The lack of co-site interference may therefore enable multiple elements to be arranged relatively close together and operate at the same or different frequencies without degrading performance. The plasma antenna elements 150 may also provide higher power, enhanced bandwidth, higher efficiency, and smaller size than metallic conducting elements acting as antennas.

The plasma antenna elements 150 may also be operated so that localized concentrations of plasma form a plasma mirror that may deflect or reflect an RF beam. Thus, in some embodiments, plasma may be enabled to be freely moved to a desired geometry to form an RF reflector using plasma diodes. RF beams may therefore be steered relatively quickly and without the need to supply any mechanical movement of transmission elements. In some embodiments, a silicon wafer or disc may be employed to act as a lens and/or reflector that can be used to collimate RF energy. The plasma antenna elements 150 may therefore be configured to act as a perfect reflector of RF energy. The plasma antenna elements 150 may therefore be employed to isolate or insulate certain areas from RF energy by forming a reflector between the source and the intended object to be isolated.

Given that the skin of the aircraft could be formed of or coated with materials that may be either reflective or absorptive of RF energy, it should be appreciated that the plasma antenna elements 150 can be operated to be either reflective or absorptive of RF energy as well. Thus, the plasma antenna elements 150 can be used to isolate the interior of the aircraft 100 from externally generated RF energy or may be operated to enhance stealth characteristics of the aircraft 100. Moreover, the characteristics may be controllable based on desired characteristics for a given operation or situation. The skin of the aircraft 100 may also form a ground plane for use in connection with operation of the plasma antenna elements 150 as antenna elements for radiating or receiving RF energy to impact, for example, the effective length of antenna elements of an array formed by the plasma antenna elements 150.

In some embodiments, the plasma antenna element 150 within any given enclosure 400 may include one or a plurality of plasma discharge tubes. In cases where multiple plasma discharge tubes are provided, the plasma discharge tubes may be arranged in any desirable orientation or configuration. In some cases, at least some of the plasma discharge tubes may be arranged in an end to end fashion so that they lie substantially inline with each other and are electrically coupled. In such an example, individual ones of the plasma discharge tubes may be selectively turned on (i.e., ionized) or off. Accordingly, given that the effective length of an antenna element may typically be desired to be set at $\frac{1}{4}\lambda$ or $\frac{1}{2}\lambda$, based on the wavelength of the signal to be received or transmitted, some embodiments may enable the controller 300 to selectively turn on (or off) plasma discharge tubes to change the effective length of the plasma antenna element 150. Alternatively, rather than selecting elements for activation that have a desired length (alone or cumulatively), some embodiments may be configured to change the effective length of the plasma antenna elements 150 to enable multiple frequency tuning from the same antenna under the control of the controller 300.

In some cases, the linear arrangement of elements of a known or preset length may therefore give the controller 300 a robust capability to alter the effective length of the plasma antenna element 150 based on the number of energized or ionized plasma discharge tubes. However, yet further flexibility with respect to control of configuration can also be provided. In this regard, although the plasma discharge tubes may be arranged in a vertical stack to provide selectability with respect to array length of a vertically oriented array, it may also be possible to define a horizontal array or any other desirable orientation. The use of plasma antenna elements 150 within the cockpit window 130 may provide for a clear view of satellite transmitters in space (e.g., satellite 270) and any desirable configuration for focusing and/or receiving satellite transmissions for processing can be implemented.

The controller 300 may also control the plasma discharge tubes to perform time and/or frequency multiplexing so that many RF subsystems (e.g., multiple different radios associated with the radio circuitry 420) may share the same antenna resources. In situations where the frequencies are relatively widely separated, the same aperture may be used to transmit and receive signals in an efficient manner. In some embodiments, higher frequency plasma antenna arrays may be arranged to transmit and receive through lower frequency plasma antenna arrays. Thus, for example, the arrays may be nested in some embodiments such that higher frequency plasma antenna arrays are placed inside lower frequency plasma antenna arrays.

Given the amount of available space within the windows of the aircraft 100, there is ample room to provide multiple arrangements and architectures to provide potential coverage for very wide frequency spectrum ranges. In some embodiments, multiple reconfigurable or preconfigured antenna elements may be provided to enable communications over a wide range of frequencies covering nearly the entire spectrum. Some ranges or specific frequencies may be emphasized for certain commercial reasons (e.g., 790 MHz to 6 GHz, 2.4 GHz, 5.8 GHz, etc.). However, in all cases, the controller 300 may be configured to provide at least some control over the frequencies, channels, multiplexing strategies, beam forming, or other technically enabling programs that are employed. Because plasma antennas can be 'tuned' in nanoseconds, fast switching could also accomplish the same goal of using the same physical plasma antenna element to communicate at high speed with multiple devices in a Time-division duplexed fashion. This capability could enhance the functional features of a cognitive radio design by providing for high-speed scanning of a wide range of frequencies, then quickly converting to a targeted frequency once identified.

As mentioned above, beam forming capabilities may be enhanced or provided by the controller 300 exercising control over the plasma antenna element 150. In this regard, for example, the plasma antenna element 150 or portions thereof may be operated to generate reflective properties or employ beam collimation so that beam steering may be accomplished. In such an example, the controller 300 may be configured to control the plasma antenna element 150 to focus or steer plasma antenna element 150 radiation patterns to allow shaping and steering of beams using a single instance of the plasma antenna element 150 without the use of a phased array. As an alternative, given the availability of space for providing multiple arrays employing the plasma antenna elements 150, the controller 300 could be used to coordinate operation of multiple plasma antenna elements 150 to act in a manner similar to a phased array by using coordination of the multiple plasma antenna elements 150 to conduct beam steering.

In still other examples, the enclosure 400 may further house a metal antenna 450 and the plasma antenna element 150 of the corresponding enclosure 400 may be used to collimate, reflect or block certain portions of the radiation pattern of the metal antenna 450 in order to facilitate beam steering. Thus, the plasma antenna element 150 may be used as a radiating or receiving element or may be used to provide directional control over the operability of the metal antenna 450.

Regardless of whether the plasma antenna elements 150 is used to radiate, receive, focus beams, steer beams, reflect beams or otherwise conduct some form of beamforming function, the controller 300 may be used to control the operation of the plasma antenna elements 150 to achieve the desired functionality. In some cases, the controller 300 may be further configured to utilize position information of the aircraft 100, ground or sea stations, satellites, other aircraft, or any other useful structures or entities in order to determine a relative position or expected relative position of another communication node and correspondingly direct a beam toward the communication node. In such an example embodiment, the memory 314 may store static position information indicative of a fixed geographic location of access points of the ATG network 210 and/or a position of satellites of the satellite communication network 240. The memory 314 may also buffer dynamic position information indicative of the current location of the aircraft 100. The processing circuitry 310 may then also be configured to process the static and dynamic position information to determine a three dimensional position of the aircraft and/or a relative position of at least one external communication node (e.g., the ATG AP 212 or the satellite 270) so that a beam may be formed and directed toward the at least one external communication node. In an example embodiment, the dynamic position information may include latitude and longitude coordinates and altitude to provide a position in 3D space. In some cases, the dynamic position information may further include heading and speed so that calculations can be made to determine, based on current location in 3D space, and the heading and speed (and perhaps also rate of change of altitude), a future location of the aircraft 100 at some future time. In some cases, flight plan information may also be used for predictive purposes to either prepare for beam steering to establish communication with external communication nodes likely to be encountered further along the track of the aircraft, or to enable the external communication nodes to conduct beam steering to direct communications toward an expected position of the aircraft 100 when the aircraft 100 will enter into communication range with the respective external communication nodes.

Figure 5:
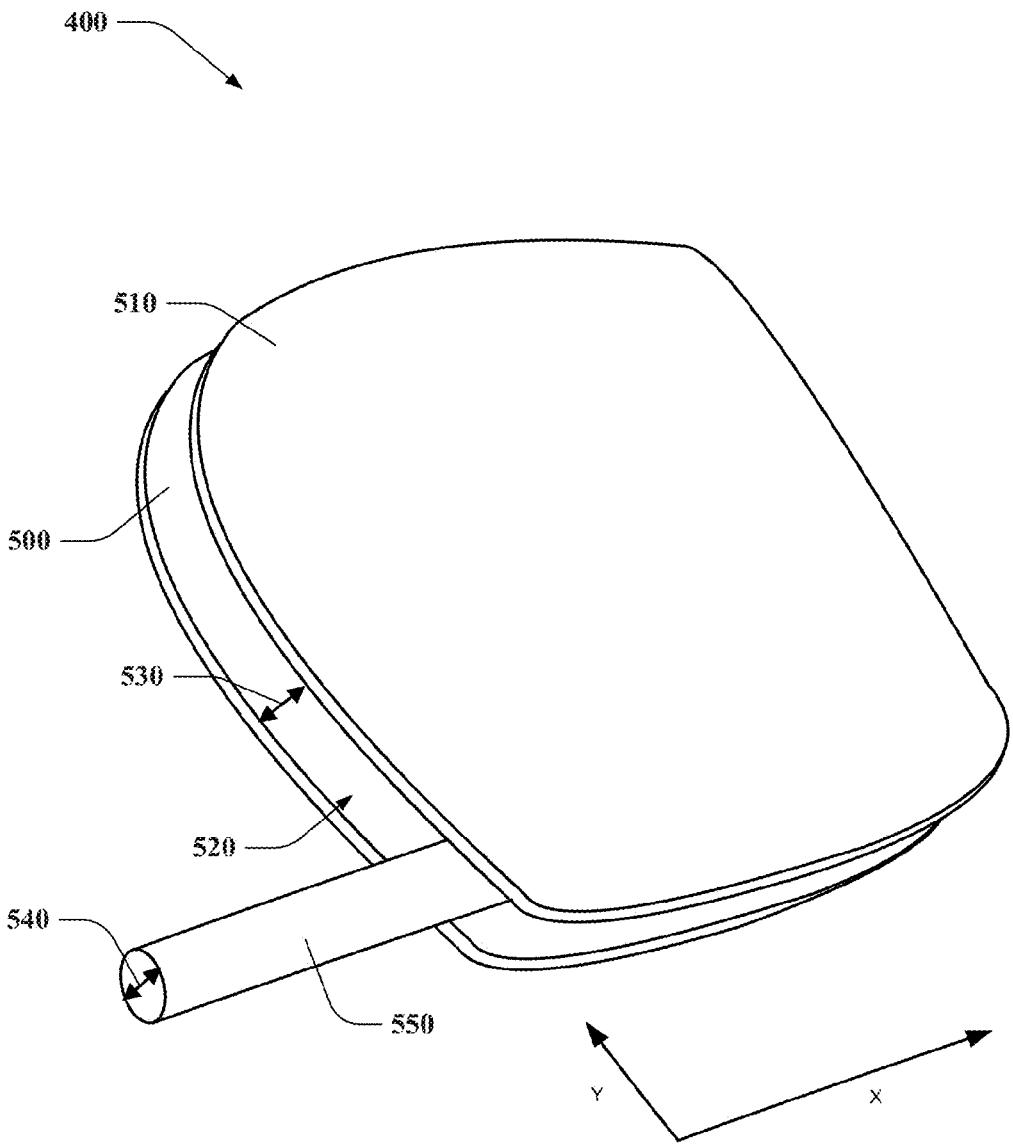
FIG. 5 illustrates one example of a physical structure that may be employed for the enclosure in accordance with an example embodiment.

FIG. 5 illustrates one example of a physical structure that may be employed for the enclosure 400 in accordance with an example embodiment. FIG. 5 is not necessarily drawn to scale, but is simply provided to illustrate the concept of construction to be employed in connection with an example embodiment. As shown in FIG. 5, the enclosure 400 may define a window (e.g., cockpit window 130 or side window 120) of the aircraft 100. The enclosure 400 may comprise a first pane 500 and a second pane 510. As discussed above, the first and second panes 500 and 510 may be made of glass or a glass substitute. The first and second panes 500 and 510 may lie spaced apart from each other in planes that are substantially parallel with each other. However, it should be appreciated that the first and second panes 500 and 510 may have curved faces in some cases. Thus, they may not necessarily lie in flat planes. Peripheral edges of the first and second panes 500 and 510 may be received at window openings in the aircraft 100. Thus, for example, the first pane 500 may be received at and sealed relative to skin of the aircraft 100 and the second pane 510 may be received at and perhaps also sealed relative to an interior surface of the aircraft 100. The first and/or second panes 500, 510 may be rated to handle pressures to which the windows of the aircraft 100 can be expected to be exposed when at altitude.

Given that the first and second panes 500 and 510 may be spaced apart from each other, the space defined between the first and second panes 500 and 510 may be a receiving space 520. The receiving space 520 may have a width 530 that is at least slightly larger than a diameter 540 of a plasma discharge tube 550 forming a portion of one of the plasma antenna elements 500. In this example, the receiving space 520 may extend substantially over an entirety of the space between faces of the first and second panes 500 and 510. However, it should be appreciated that the receiving space 520, and the portions of the first and second panes 500 and 510 that are adjacent to one or more of the plasma discharge tubes 550, could be limited to only selected portions of space between faces of the first and second panes 500 and 510 in various example embodiments. The diameter 540 of plasma discharge tube 550 may impact the amount of driving current needed to ionize the gas provided in the plasma discharge tube 550. Accordingly, it may be desirable to employ a relatively small diameter 540 for the plasma discharge tube 550. However, it should be appreciated that any suitable size and shape for the plasma discharge tubes 550 (including non-tubular or cylindrical shapes) may be employed in some alternative embodiments.

In some exemplary embodiments, magnetic fields may influence plasma generation. Accordingly, in some cases, magnetic fields may also be provided to control or influence the operation of the plasma discharge tube 550. Thus, for example, permanent magnets or temporarily magnetized ferromagnetic materials may be employed proximate to the plasma discharge tube 550 to influence operation thereof. In some cases, the controller 300 may also be employed to control the magnets that may be temporarily magnetized to achieve desired results relative to controlling or influencing operation of the plasma discharge tube 550.

The plasma discharge tube 550 may be provided within the receiving space 520 along any desired orientation. Thus, although this example shows the plasma discharge tube 550 being installed within the receiving space 520 along the X axis direction, the plasma discharge tube 550 could alternatively be installed along the Y axis direction or at an angle relative to the X or Y axis. Moreover, it should be appreciated that the plasma discharge tube 550 may be fully inserted within the receiving space 520 so that, in some embodiments, no portion of the plasma discharge tube 550 may extend beyond the peripheral edges of the first and second panes 500 and 510. In some examples, one or both ends of the plasma discharge tube 550 may extend past the peripheral edges of the first and second panes 500 and 510 to contact portions of an ionizer that applies power to the plasma discharge tube 550 under the control of the controller 300.

It should also be appreciated that although FIG. 5 only shows a simple example in which a single plasma discharge tube 550 is shown, other examples may include multiple plasma discharge tubes. When multiple plasma discharge tubes are provided, some or all of the additional plasma discharge tubes may be arranged in parallel with the plasma discharge tube 550, inline with the plasma discharge tube 550, at an angle relative to the plasma discharge tube 550, or in any other suitable orientation. For example, in some embodiments, one or more plasma discharge tubes 550 may be oriented in a first direction (e.g., along the X axis), while one or more other plasma discharge tubes 550 are oriented along a second direction (e.g., along the Y axis). The plasma discharge tubes 550 may lie in the same plane or in parallel planes and may be used individually or in combination with one another to polarize, focus, steer or otherwise control the radiation patterns and characteristics of the antenna elements formed thereby under the control of the controller 300.

Figure 6:
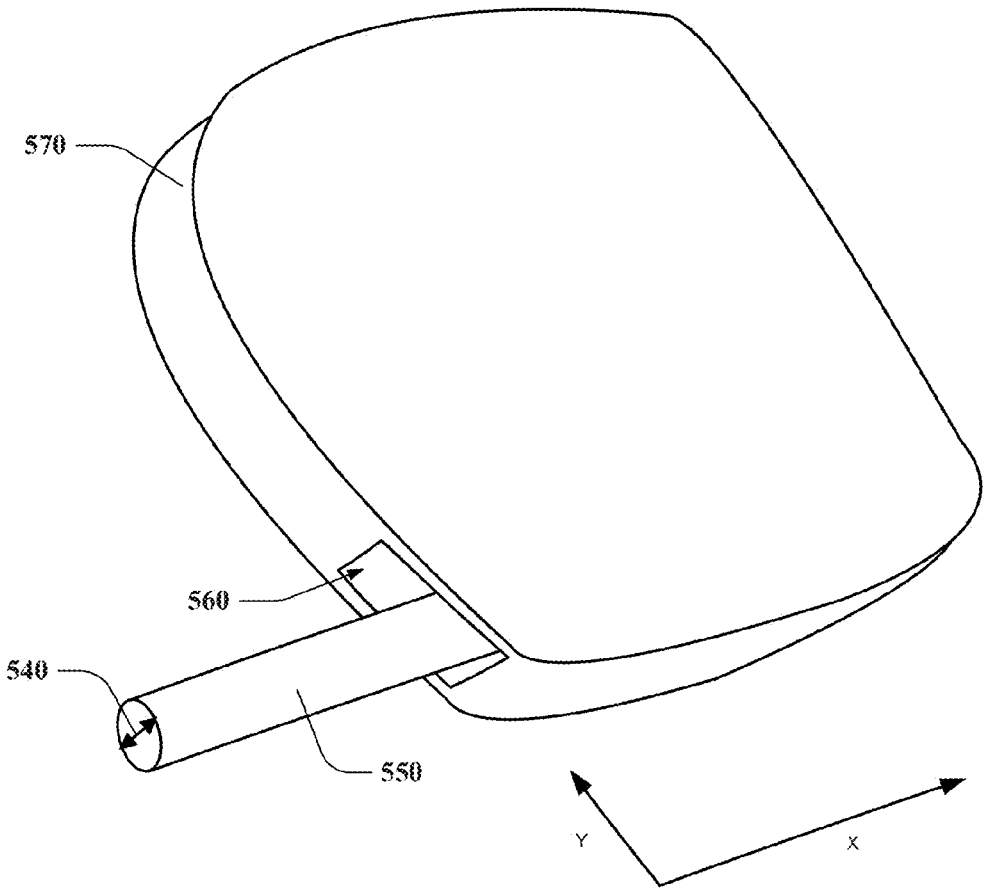
FIG. 6 illustrates an embodiment in which an alternative receiving space may be defined within a single pane in accordance with an example embodiment.
Figure 7:
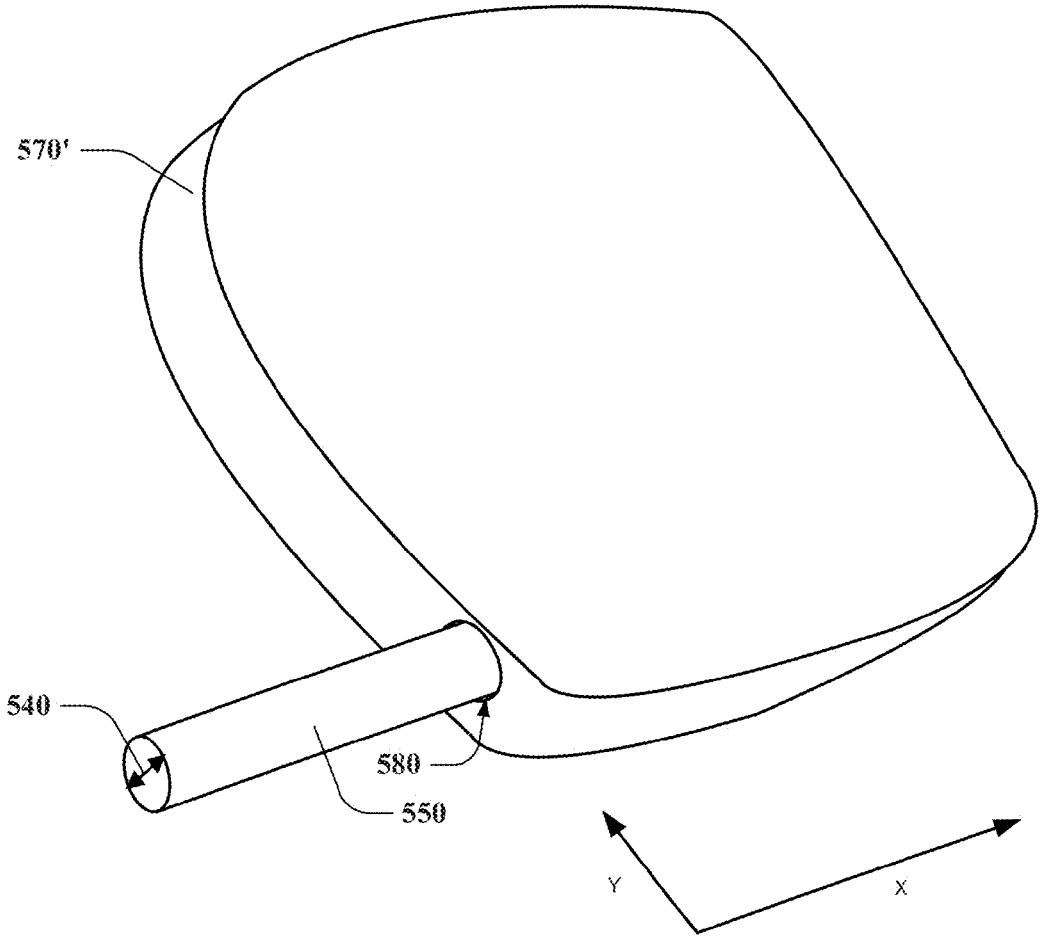
FIG. 7 illustrates an example in which a receiving space is provided in the single pane to substantially match the shape of the plasma discharge tube in accordance with an example embodiment.
Figure 8:
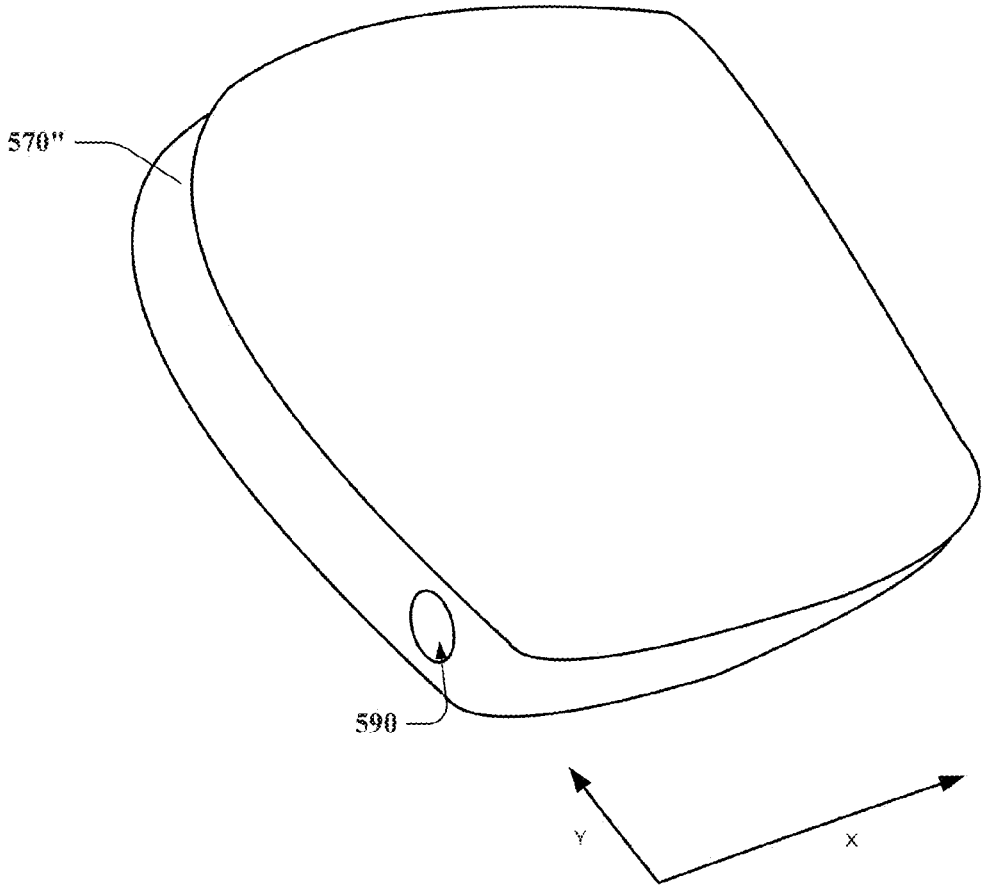
FIG. 8 illustrates an example in which the receiving space receives the gas to be ionized so that the plasma discharge tube is not a separate structure from the single pane in accordance with an example embodiment.

Other window structures are also possible in some cases. For example, FIG. 6 illustrates an embodiment in which an alternative receiving space 560 may be defined within a single pane 570. In this embodiment, the receiving space 560 may be etched out of the single pane 570 or may be formed as a hollow space within the single pane 570 when the single pane 570 is formed. The receiving space 560 could have any suitable shape as long as the receiving space 560 has sufficient diameter, length and/or width to receive the plasma discharge tube 550. For example, FIG. 7 illustrates an example in which a receiving space 580 is provided in the single pane 570' to substantially match the shape of the plasma discharge tube 550. In still other examples, such as the example of FIG. 8, the receiving space 590 may actually receive the gas to be ionized so that the plasma discharge tube is not a separate structure from the single pane 570". Again, it should be appreciated that the receiving spaces and the corresponding amount of the visible surface of the window or panes thereof that can have plasma discharge tubes proximate thereto may be small or large. In some cases, the receiving space and the plasma discharge tubes may cover substantially all visible portions of the window after it is installed within the aircraft 100.

Figure 9:
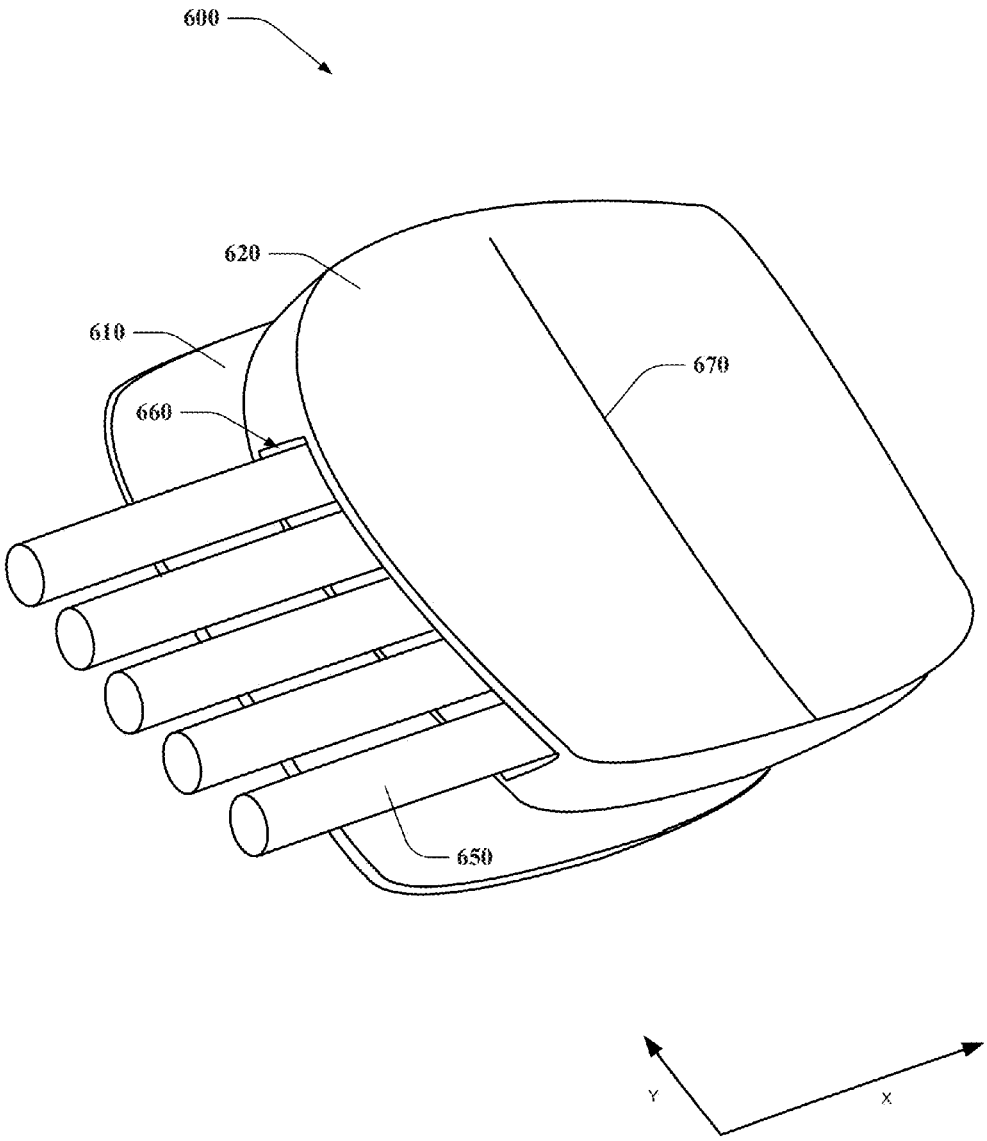
FIG. 9 illustrates an example of the modular aircraft window of an example embodiment.

In some embodiments, a modular aircraft window 600 may be provided. FIG. 9 illustrates an example of the modular aircraft window 600 of an example embodiment. In such an example, at least an outer pane 610 of the modular aircraft window 600 may be fixed to the aircraft 100 and may be rated for pressure at altitude. Meanwhile, at least an inner pane 620 of the aircraft 100 may be similar to one of the panes shown in FIGS. 6 to 8, but may be removable. In this regard, the inner pane may be configured to receive one or more plasma discharge tubes 630 therein to form the plasma antenna element 150, and may be replaceable dependent upon the desired communication properties for the modular aircraft window 600. In such an example, various different instances of the plasma antenna element 150 may be formed in multiple respective preconfigured orientations and/or configurations to create different selectable specific instances of the inner panes 620. Dependent upon the specific configuration that is desired for implementation on a given flight or mission, based on communication properties desired for the flight or mission, a corresponding inner pane having the desired specific configuration may be provided in the modular aircraft window 600.

In the example of FIG. 9, a plurality of plasma discharge tubes 650 are provided in parallel with each other to fit within a receiving opening 660. It should be understood that the plasma discharge tubes 650 may be further inserted into the receiving opening 660 along the X direction, and that they are merely shown protruding from the receiving opening 660 to facilitate explanation of the structure of one embodiment. In some cases, some of the plasma discharge tubes 650 may be provided to have different effective lengths when ionized. The controller 300 may select one or more of the plasma discharge tubes 650 having different lengths so that communication may be conducted via selected frequencies based on the effective length of the selected plasma discharge tubes 650.

Alternatively or additionally, a metal antenna 670 may also be provided in the inner pane 620. The plasma discharge tubes 650 may be selected or otherwise operated to block, focus or steer radiation from the metal antenna 670 (e.g., under control of the controller 300) to achieve a desired beam pattern. Different embodiments of the inner pane 620 may have different metal antennas, different numbers, orientations and/or lengths of plasma discharge tubes 650, or other characteristics that may give various ones of the inner panes 620 different communications capabilities and/or characteristics. The inner panes 620 to be used for any particular flight or mission may therefore be selected to optimize the performance of the system. Either or both of the inner panes 620 and the outer panes 610 may be made of electrochromic glass. In such example embodiments, the controller 300 may therefore provide for control of the communication properties of the modular aircraft window 600 and the transparency characteristics of the modular aircraft window 600.

In some embodiments, rather than having the inner pane 620 include the plasma discharge tubes 650 and/or the metal antenna 670 therein, the inner pane 620 could simply be a removable pane to allow the plasma discharge tubes 650 and/or the metal antenna 670 to be provided in the space between the outer pane 610 and the inner pane 620. In some cases, a preformed receptacle may be provided to receive the plasma discharge tubes 650 and/or the metal antenna 670 for insertion between the outer pane 610 and the inner pane 620 of a modular window.

Referring again to FIG. 1, in an example embodiment, the interior of the aircraft 100 may be provided with a local communications network. For example, WiFi or some other short range communication network may be established within the confines of the fuselage 110. Meanwhile, enclosures capable of carrying plasma antenna elements 150 may be provided in the windows or at other portions of the skin of the aircraft 100. The plasma antenna elements 150 could be used to block external signals from entering into or propagating out of the aircraft 100. Alternatively or additionally, the plasma antenna elements 150 could communicate with external communication equipment (e.g., of the ATG network 210 or of the satellite communication network 240) and pass such communications along to the internal or local communications network. The data or information received from external communication equipment may or may not be stored prior to distribution of such data or information via the local communications network. Example embodiments may therefore be employed to isolate different RF environments. In some embodiments, interference rejection may therefore be accomplished and active nulling may be achieved to inhibit jamming efforts.

The controller 300 may therefore be configured to control one or more plasma antenna elements of any desired length. In one embodiment, the highest and/or lowest desired frequencies may be used to define the corresponding shortest and longest antenna element effective lengths that are needed. The controller 300 may selectively ionize specific ones of the plasma discharge tubes to achieve the desired frequency of operation. The selective control provided by the controller 300 may include selecting a single tube providing the desired length when ionized, or selecting multiple tubes that when ionized together and electrically coupled provide an element having the desired effective length.

Figure 10:
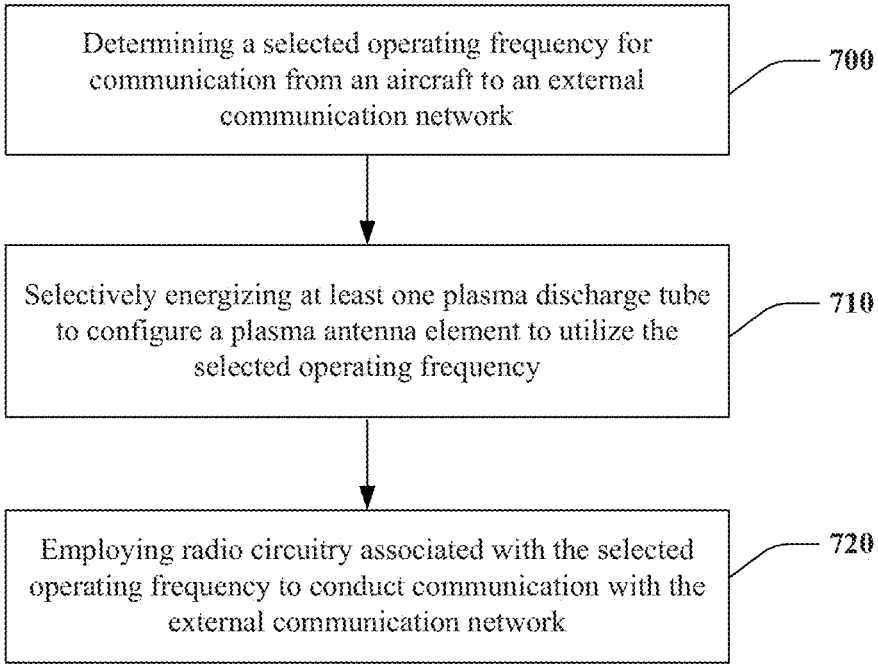
FIG. 10 illustrates a block diagram of a method for employing a plasma antenna element in accordance with an example embodiment.

In some example embodiments, the system of FIG. 2 may provide an environment in which the controller 300 of FIG. 3 may provide a mechanism via which a number of useful methods may be practiced. FIG. 10 illustrates a block diagram of one method that may be associated with the system of FIG. 2 and the controller 300 of FIG. 3. From a technical perspective, the controller 300 described above may be used to support some or all of the operations described in FIG. 10. As such, the platform described in FIG. 2 may be used to facilitate the implementation of several computer program and/or network communication based interactions. As an example, FIG. 10 is a flowchart of a method and program product according to an example embodiment of the invention. It will be understood that each block of the flowchart, and combinations of blocks in the flowchart, may be implemented by various means, such as hardware, firmware, processor, circuitry and/or other device associated with execution of software including one or more computer program instructions. For example, one or more of the procedures described above may be embodied by computer program instructions. In this regard, the computer program instructions which embody the procedures described above may be stored by a memory device (e.g., of the controller 300) and executed by a processor in the device. As will be appreciated, any such computer program instructions may be loaded onto a computer or other programmable apparatus (e.g., hardware) to produce a machine, such that the instructions which execute on the computer or other programmable apparatus create means for implementing the functions specified in the flowchart block(s). These computer program instructions may also be stored in a computer-readable memory that may direct a computer or other programmable apparatus to function in a particular manner, such that the instructions stored in the computer-readable memory produce an article of manufacture which implements the functions specified in the flowchart block(s). The computer program instructions may also be loaded onto a computer or other programmable apparatus to cause a series of operations to be performed on the computer or other programmable apparatus to produce a computer-implemented process such that the instructions which execute on the computer or other programmable apparatus implement the functions specified in the flowchart block(s).

Accordingly, blocks of the flowchart support combinations of means for performing the specified functions and combinations of operations for performing the specified functions. It will also be understood that one or more blocks of the flowchart, and combinations of blocks in the flowchart, can be implemented by special purpose hardware-based computer systems which perform the specified functions, or combinations of special purpose hardware and computer instructions.

In this regard, a method according to one embodiment of the invention, as shown in FIG. 10, may include determining a selected operating frequency for communication from an aircraft to an external communication network at operation 700. The method may further include selectively energizing at least one plasma discharge tube to configure a plasma antenna element to utilize the selected operating frequency at operation 710, and employing radio circuitry associated with the selected operating frequency to conduct communication with the external communication network at operation 720.

In some embodiments, the method may include additional, optional operations, and/or the operations described above may be modified or augmented. Some examples of modifications, optional operations and augmentations are described below. It should be appreciated that the modifications, optional operations and augmentations may each be added alone, or they may be added cumulatively in any desirable combination. In an example embodiment, selectively energizing at least one plasma discharge tube to configure a plasma antenna element to utilize the selected operating frequency may include selectively energizing a single plasma discharge tube having an effective length corresponding to the selected operating frequency. Alternatively or additionally, selectively energizing at least one plasma discharge tube to configure a plasma antenna element to utilize the selected operating frequency may include selectively energizing a plurality of plasma discharge tubes to define an antenna element having an effective length corresponding to the selected operating frequency.

In some embodiments, the controller that performs the method above (or a similar controller) may be a portion of an aircraft communication system. Thus, for example, some embodiments may provide for the aircraft communications system to include a RF-transparent enclosure, a plasma antenna element and the controller. The RF-transparent enclosure may be disposed substantially conformal with skin of the aircraft (e.g., to support a conformal antenna design). The plasma antenna element may be housed within the RF-transparent enclosure. The controller may be operably coupled to the plasma antenna element to provide control of operation of the plasma antenna element. The plasma antenna element may include one or more plasma discharge tubes including gas that is selectively ionized to a plasma state under control of the controller.

In an example embodiment, the controller may be configured to control the plasma antenna element to selectively ionize at least two different plasma discharge tubes to define a desired effective length of an antenna element. Alternatively or additionally, the controller may be configured to control the plasma antenna element to selectively ionize at least two different plasma discharge tubes of different effective lengths to define two different operating frequencies.

In some embodiments, the RF-transparent enclosure may be a window of the aircraft. In such an example, the window may be a side window of the aircraft and the controller may be configured to enable communication with terrestrial base stations of an air-to-ground (ATG) network. Alternatively or additionally, the window may be a cockpit window of the aircraft and the controller may be configured to enable communication with a satellite of a satellite communication network. In an example embodiment, the window may include at least one pane having a receiving opening for receiving the one or more plasma discharge tubes formed therein. Alternatively or additionally, the window may include an outer pane and an inner pane and the one or more plasma discharge tubes may be disposed between the outer pane and the inner pane. As yet another alternative or additional feature, the window of some embodiments may include at least one pane including a receiving opening where the receiving opening contains the gas and is shaped to form the one or more plasma discharge tubes. In some cases, the window may be a modular aircraft window including a fixed outer pane and a removable inner pane, the removable inner pane being removable to enable replacement of the plasma antenna element.

In an example embodiment, the controller may be configured to control the plasma antenna element to perform beam steering. The beam steering may be performed by, for example, focusing or blocking portions of a radiation pattern generated by a metal antenna. In some cases, the controller may be configured to control the plasma antenna element to block a selected frequency. Alternatively or additionally, the controller may be configured to control the plasma antenna element to transmit a lower frequency from one portion of an array nested within another portion of the array transmitting a higher frequency.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

What is claimed is:

1. An aircraft communications system comprising:

an RF transparent enclosure disposed substantially conformal with a portion of the aircraft;

a plasma antenna element housed within the RF-transparent enclosure; and a controller operably coupled to the plasma antenna element to provide control of operation of the plasma antenna element, wherein the plasma antenna element includes one or more RF-conductive plasma devices that are selectively ionizable to a plasma state under control of the controller, and wherein the controller is configured to control the plasma antenna element to selectively ionize at least two different RF-conductive plasma devices electrically coupled to define a desired effective length of an antenna element.

2. The aircraft communications system of claim 1, wherein the controller is configured to control the plasma antenna element to selectively ionize at least two different RF-conductive plasma devices of different effective lengths to define two different operating frequencies.

3. The aircraft communications system of claim 1, wherein the RF-transparent enclosure is a window of the aircraft.

4. The aircraft communications system of claim 3, wherein the window is a side window of the aircraft and the controller is configured to enable communication with terrestrial base stations of an air-to-ground (ATG) network.

5. The aircraft communications system of claim 3, wherein the window is a cockpit window of the aircraft and the controller is configured to enable communication with a satellite of a satellite communication network.

6. The aircraft communications system of claim 3, wherein the window comprises at least one pane including a receiving opening for receiving the one or more RF-conductive plasma devices.

7. The aircraft communications system of claim 3, wherein the window comprises an outer pane and an inner pane and wherein the one or more RF-conductive plasma devices are disposed between the outer pane and the inner pane.

8. The aircraft communications system of claim 3, wherein RF-conductive plasma devices comprise plasma discharge tubes, and wherein the window comprises at least one pane including a receiving opening and the receiving opening contains the gas and is shaped to form the plasma discharge tubes.

9. The aircraft communications system of claim 3, wherein the window is a modular aircraft window including a fixed outer pane and a removable inner pane, the removable inner pane being removable to enable replacement of the plasma antenna element.

10. The aircraft communications system of claim 1, wherein the controller is configured to control the plasma antenna element to perform beam steering.

11. The aircraft communications system of claim 10, wherein the controller performs beam steering by focusing or blocking portions of a radiation pattern generated by a metal antenna.

12. The aircraft communications system of claim 1, wherein the controller is configured to control the plasma antenna element to block a selected frequency.

13. An aircraft communications system comprising:

an RF transparent enclosure disposed substantially conformal with a portion of the aircraft;

a plasma antenna element housed within the RF-transparent enclosure; and a controller operably coupled to the plasma antenna element to provide control of operation of the plasma antenna element, wherein the plasma antenna element includes one or more RF-conductive plasma devices that are selectively ionizable to a plasma state under control of the controller, and wherein the controller is configured to control the plasma antenna element to transmit a lower frequency from one portion of an array nested within another portion of the array transmitting a higher frequency.

14. A modular aircraft window comprising:

a RF-transparent enclosure disposed substantially conformal with a portion of the aircraft, the RF-transparent enclosure including a fixed outer pane and a removable inner pane;

a plasma antenna element housed within the RF-transparent enclosure; and a controller operably coupled to the plasma antenna element to provide control of operation of the plasma antenna element, wherein the plasma antenna element includes one or more RF-conductive plasma discharge tubes that are selectively ionizable to a plasma state under control of the controller, and wherein the removable inner pane is removable to enable replacement of the plasma antenna element to a selected one of a plurality of preconfigured structures, the preconfigured structures being different from each other relative to a number of the plasma discharge tubes, an orientation of the plasma discharge tubes, or a length of the plasma discharge tubes forming the plasma antenna element.

15. The modular aircraft window of claim 14, wherein the one or more RF-conductive plasma devices are provided between the fixed outer pane and the removable inner pane.

16. The modular aircraft window of claim 14, wherein the one or more RF-conductive plasma devices are provided within the removable inner pane.

* * * * *